US008967779B2

(12) United States Patent
Tsukahara et al.

(10) Patent No.: US 8,967,779 B2
(45) Date of Patent: Mar. 3, 2015

(54) FLOW CHANNEL MEMBER, LIQUID EJECTING HEAD, LIQUID EJECTING APPARATUS, AND LIQUID RESERVOIR

(71) Applicant: Seiko Epson Corporation, Tokyo (JP)

(72) Inventors: Katsutomo Tsukahara, Matsumoto (JP); Keiji Hara, Yokohama (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/973,235

(22) Filed: Aug. 22, 2013

(65) Prior Publication Data

US 2014/0063137 A1 Mar. 6, 2014

(30) Foreign Application Priority Data

Aug. 30, 2012 (JP) ..... 2012-189627

(51) Int. Cl.
*B41J 2/175* (2006.01)
*B41J 2/14* (2006.01)
*B41J 2/17* (2006.01)

(52) U.S. Cl.
CPC . *B41J 2/17* (2013.01); *B41J 2/1752* (2013.01)
USPC ..... 347/86; 347/49

(58) Field of Classification Search
USPC ..... 347/49, 84, 85, 86
See application file for complete search history.

(56) References Cited

U.S. PATENT DOCUMENTS 6,086,193 A * 7/2000 Shimada et al. ..... 347/86
7,997,702 B2 * 8/2011 Kimura et al. ..... 347/86
8,066,363 B2 * 11/2011 Greer et al. ..... 347/93

FOREIGN PATENT DOCUMENTS

JP 2007-015272 A 1/2007

* cited by examiner

*Primary Examiner* — Anh T. N. Vo
(74) *Attorney, Agent, or Firm* — Harness, Dickey & Pierce, P.L.C.

(57) ABSTRACT

A flow channel member to which an ink cartridge is removably mounted has a sealing member made of an elastic material around the entire periphery of an installation section of a flow channel member main body. The sealing member is integrally formed of: a top plane portion, where an end face of a leg portion abuts the top plane portion so as to define an enclosed space between an inner peripheral surface of the leg portion and an outer peripheral surface of the installation section; and an inner leg portion and an outer leg portion extending from edges of the top plane portion along the longitudinal axis of the installation section, and having end faces, abutting the flow channel member main body. Furthermore, the sealing member has curved thicker portions.

15 Claims, 6 Drawing Sheets

FLOW CHANNEL MEMBER, LIQUID EJECTING HEAD, LIQUID EJECTING APPARATUS, AND LIQUID RESERVOIR

BACKGROUND

1. Technical Field

The present invention relates to a flow channel member, a liquid ejecting head, a liquid ejecting apparatus incorporating the liquid ejecting head, and a liquid reservoir mountable on the flow channel member, and particularly relates to a technique efficiently applicable to a flow channel member, a liquid ejecting head, and a liquid ejecting apparatus, having a sealing member for maintaining liquid tightness between the flow channel member and a liquid reservoir removably mounted on the flow channel member.

2. Related Art

A typical liquid ejecting head for discharging liquid droplets includes an ink jet recording head for discharging ink droplets. For example, JP-A-2007-015272 has proposed, for example, an ink jet recording head having a head body for discharging ink droplets from a nozzle port, and a channel member, to which a head body is secured and to which an ink cartridge (a liquid reservoir) for storing the ink is removably arranged, for supplying the ink from the ink cartridge to the head body.

According to JP-A-2007-015272, a supply section composed of a pressing portion formed of a porous material or the like is arranged on an ink cartridge and pressed against a filter arranged in an installation section of a flow channel member, thereby interconnecting the ink cartridge and the flow channel member. In this case, it is necessary to prevent water in ink from evaporating and to prevent thickening of the ink, which in turn affects ink discharge. To this end, an enclosed space is formed in the periphery of the supply section of the ink cartridge and the filter. That is, an annular sealing member is disposed in the periphery of the installation section including an opening having the filter disposed therein, and the lower end face of a leg portion annularly projecting from the ink cartridge abuts a top plane portion of the sealing member, whereby predetermined liquid tightness is maintained.

According to the sealing member disclosed in JP-A-2007-015272, an inner leg portion adjacent to the installation section and an outer leg portion located away from the installation section project from the both edges of the top plane portion in the direction away from the ink cartridge to make a concave cross-sectional shape. Connecting portions between the top plane portion and the inner leg portion and between the top plane portion and the outer leg portion make a right angle.

In JP-A-2007-015272, as described above, since the connecting portions of the top plane portion to the inner leg portion and the outer leg portion of the sealing member make a right angle, repeated attaching and detaching of an ink cartridge causes the stress from the pressing load acting on the top plane portion of the sealing member via the leg portions of the ink cartridge to be concentrated on the connecting portions thereby causing the top plane portion to sag downward, thereby decreasing the adhesion with the ink cartridge.

Thickening the sealing member improves such creep resistance; however, it adversely increases the reaction force acting from the sealing member on the ink cartridge. Therefore, it has a limitation in this respect.

Further, these problems exist not only in the flow channel member used in the liquid ejecting head such as the ink jet recording head, but also in flow channel members used in devices other than a liquid ejecting head.

SUMMARY

An advantage of some aspects of the invention is that it provides a flow channel member, a liquid ejecting head, and a liquid ejecting apparatus having a sealing member having improved creep resistance and sealing performance due to uniformly distributing stress.

An aspect of the invention provides a flow channel member disposed between a liquid reservoir for storing a liquid therein and a head body for ejecting the liquid, the flow channel member including: a flow channel member main body having a liquid flow channel, through which a liquid flows from the liquid reservoir via one port into the head body via another port and having an installation section for mounting the liquid reservoir constituted by the periphery of the one port; and a sealing member made of an elastic material, arranged around the entire periphery of the installation section of the flow channel member main body. The sealing member is integrally formed of: a top plane portion, where an end face of an annular leg portion of the liquid reservoir abuts the top plane portion so as to define an enclosed space between an inner peripheral surface of the leg portion and an outer peripheral surface of the installation section; and an inner leg portion adjacent to the installation section and an outer leg portion away from the installation section, extending from an inner edge and an outer edge of the top plane portion, respectively, along the longitudinal axis of the installation section in a direction away from the enclosed space, and each having a face abutting the flow channel member main body. Furthermore, at least a portion of the sealing member has a thicker portion formed so that the thickness of the at least inner leg portion increases gradually from the end face of the inner leg portion toward the top plane portion so that the distance between the inner peripheral surface of the inner leg portion and the inner peripheral surface of the outer leg portion decreases gradually.

According to the aspect of the invention, at least a portion of the inner leg portion has a thicker portion to distribute stress acting thereon via the top plane portion. As a result, the creep resistance of the sealing member may be improved, and the adhesion of the outer peripheral surface of the inner leg portion with respect to the outer peripheral surface of the installation member may be stably maintained over the long term. In addition, the amount of liquid leakage from the enclosed space may also be minimized.

It is desirable that the inner peripheral surface of the thicker portion of the sealing member be formed into a curved surface. With such a structure, the stress acting on the sealing member may be efficiently distributed. In addition, it is desirable that the sealing member be formed so that the leg portion of the liquid reservoir is arranged on the flow channel member so as to abut the top plane portion at a position offset from the center of the width of the top plane portion toward the outer leg portion, when the liquid reservoir is mounted on the flow channel member. Therefore, the width of the top plane portion of the sealing member may be reduced without decreasing the sealing performance.

Furthermore, it is desirable that the end faces of the outer leg portion and the inner leg portion of the sealing member be curved. In this case, even if the inner leg portion and the outer leg portion of the sealing member are arranged obliquely with respect to the flow channel member main body, the gap between the end faces of the inner leg portion and the outer leg portion and the flow channel member main body may be removed to maintain satisfactory seal performance.

In addition, another aspect of the invention provides a liquid ejecting head including the flow channel member.

According to the aspect, stable sealing performance between the liquid reservoir and the flow channel member is achieved over the long term with the result that the discharge property of liquid droplets may be maintained properly.

Furthermore, another aspect of the invention provides a liquid ejecting apparatus including the liquid ejecting head.

According to the aspect, a more reliable and compact liquid ejecting apparatus may be achieved.

Furthermore, another aspect of the invention provides a liquid ejecting apparatus including the flow channel member.

According to the aspect, a more reliable and compact liquid ejecting apparatus may be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described in detail with reference to the accompanying drawings.

Figure 1:
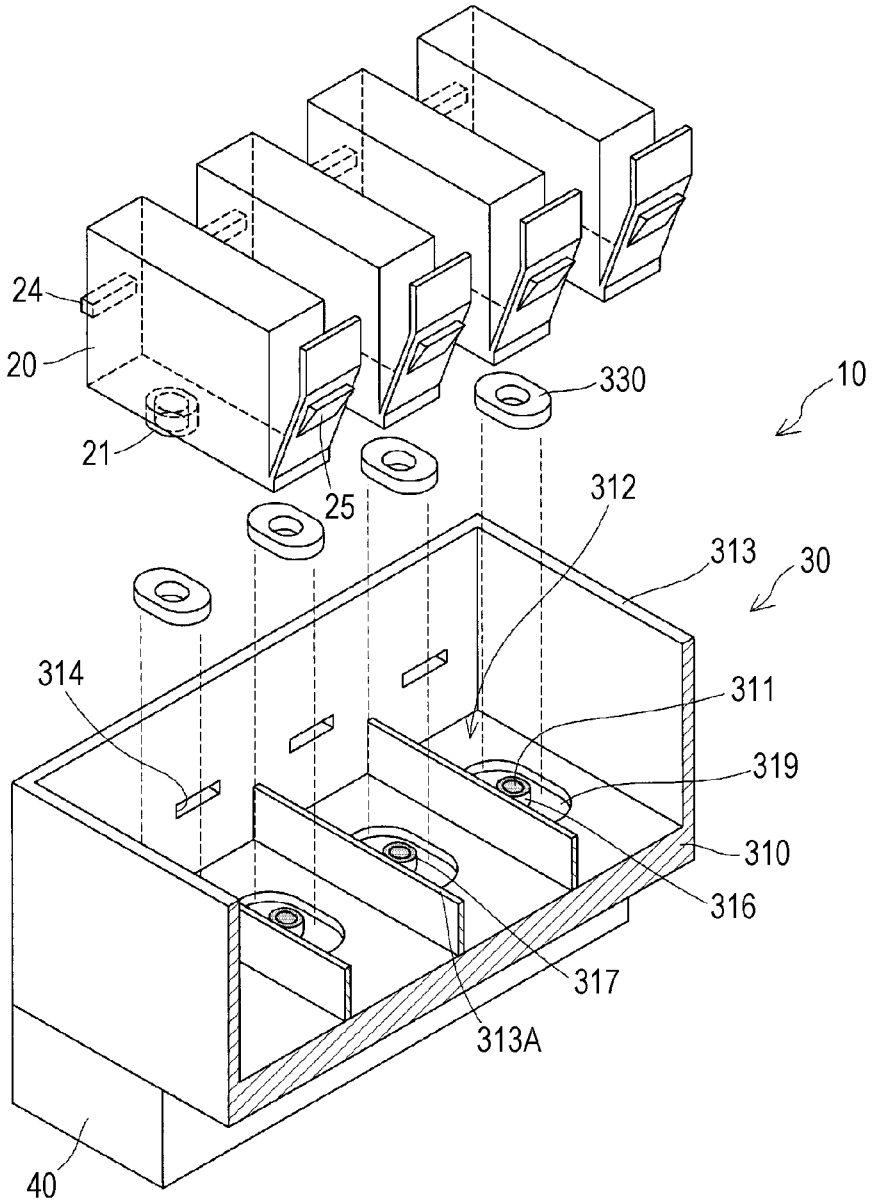
FIG. 1 is an exploded perspective view of a recording head according to an embodiment.
Figure 2A:
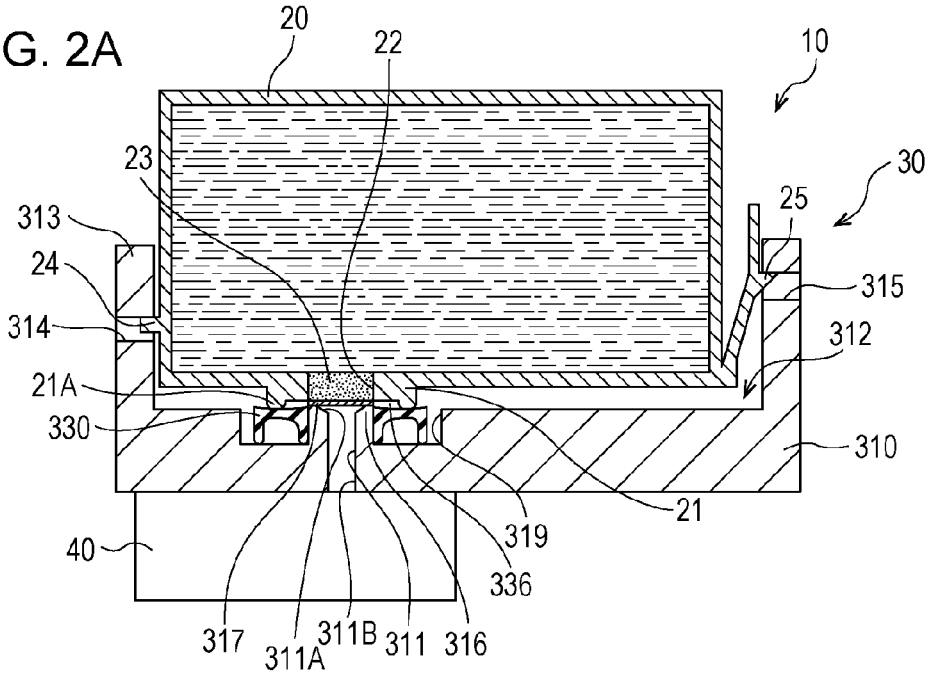
FIGS. 2A to 2C are sectional views of the recording head according to the embodiment.
Figure 2B:
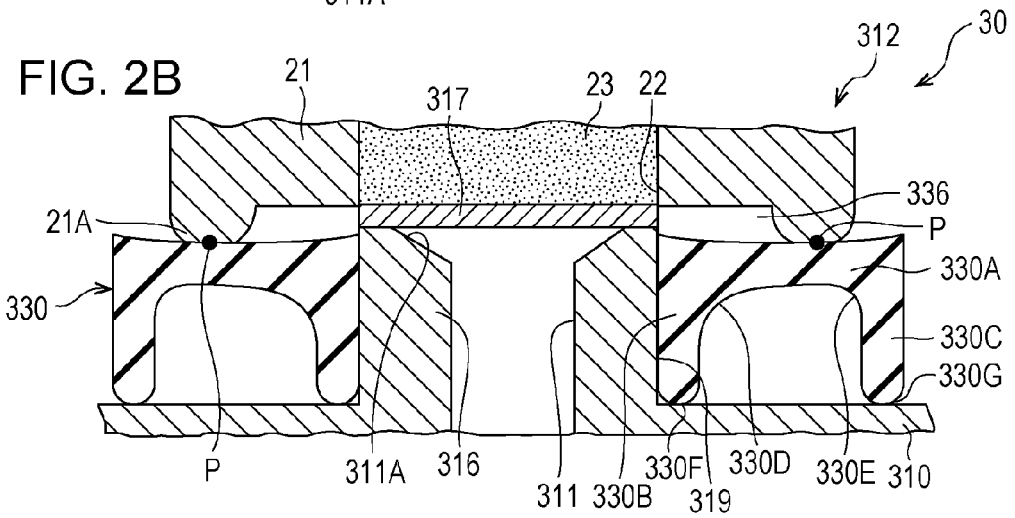
Figure 2C:
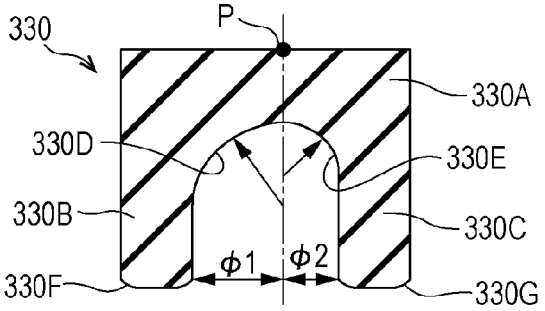

FIG. 1 is an exploded perspective view of an ink jet recording head of a liquid ejecting head according to an embodiment of the invention. FIGS. 2A to 2C are sectional views of the recording head with an ink cartridge, i.e., a liquid reservoir for storing a liquid ink that has been mounted on a flow channel member.

As shown in FIGS. 1 and 2A to 2C, an ink jet recording head 10 is provided with a flow channel member 30 having ink cartridges 20, i.e., liquid reservoirs for storing ink that can be attached to or detached from the flow channel member 30, and a head body 40 secured to the flow channel member 30.

The flow channel member 30 is provided with a flow channel member main body 310, a filter 317, and a sealing member 330 arranged in the flow channel member main body 310. A liquid flow channel 311 is formed in the flow channel member main body 310. Through the liquid flow channel 311, the ink flows via a filter chamber 311A, i.e., one opening of the channel 311, from the ink cartridge 20 into the head body 40 via the other opening 311B. The filter chamber 311A is formed into a cone-shaped space with its diameter increasing gradually toward the open end. A cartridge mounting section 312 for mounting the ink cartridge 20 is arranged adjacent to the filter chamber 311A of the liquid flow channel 311.

In the case of the embodiment, four ink cartridges are mounted on the cartridge mounting section 312. In addition, the periphery of the cartridge mounting section 312 is surrounded by a wall portion 313, and first engagement holes 314 are arranged so as to penetrate the thickness of one of a pair of opposing walls of the wall portion 313. In addition, second engagement holes 315 are arranged to penetrate the thickness of another wall opposing the wall including the first engagement holes 314. A first engagement claw 24 and a second engagement claw 25 of the ink cartridge 20 are engaged with the first engagement hole 314 and the second engagement hole 315, respectively, whereby the ink cartridge 20 is mounted on the cartridge mounting section 312.

According to the embodiment, in order to mount the four ink cartridges 20 on the cartridge mounting section 312, partition plates 313A are arranged between the ink cartridges 20 so as to divide the cartridge mounting section 312.

In addition, cylindrically projecting installation sections 316 are arranged in the cartridge mounting section 312 of the flow channel member main body 310. According to the embodiment, in order to secure the four ink cartridges to the cartridge mounting section 312, similarly four installation sections 316 are arranged. Each of the installation sections 316 according to the embodiment has the shape of a cylinder having the liquid flow channel 311 opening at its tip surface. The filter 317 for covering a port of the liquid flow channel 311 is arranged on the tip surface at which the liquid flow channel 311 opens. The installation section 316 forms a portion of the liquid flow channel 311, and the filter 317 is disposed to cover the filter chamber 311A at its tip portion. The filter 317 is intended to remove foreign substances and bubbles contained in the liquid ink, and has the shape of a disk whose area is substantially the same as that of the tip surface of the installation section 316 (the filter chamber 311A of the liquid flow channel 311). The circumference of the filter 317 is arranged at substantially the same position as the circumference of the installation section 316. In addition, an annular sealing groove 319 is arranged around the periphery of the installation section 316 on which the filter 317 is arranged, and a sealing member 330 is disposed in the sealing groove 319.

In particular as shown in FIGS. 2B and 2C in enlarged dimensions, the sealing member 330 according to the embodiment is integrally formed of a top plane portion 330A, an inner leg portion 330B, and an outer leg portion 330C, and has a generally concave cross section. Abutment of the end face of an annular leg portion 21A of the ink cartridge 20 to the top plane portion 330A defines an enclosed space 336 between the inner peripheral surface of the leg portion 21A and the outer peripheral surface of the installation section 316. The inner leg portion 330B extends from one edge of the top plane portion 330A along the longitudinal axis of the installation section 316 in a direction away from the enclosed space 336 (downward in FIGS. 2A to 2C), and abuts at the lower end face thereof the flow channel member main body 310 in the sealing groove 319. In addition, the outer leg portion 330C extends from the other edge of the top plane portion 330A along the longitudinal axis of the installation section 316 in the direction away from the enclosed space 336 (downward in FIGS. 2A to 2C), and abuts at the lower end face thereof the flow channel member main body 310 in the sealing groove 319. Thus, when the ink cartridge 20 is mounted on the flow channel member 30, the enclosed space 336 is liquid-tightly formed by the sealing member 330.

Furthermore, in a joint portion of the inner leg portion 330B and the top plane portion 330A and a joint portion of the outer leg portion 330C and the top plane portion 330A, a portion from the inner peripheral surface of the inner leg portion 330B to the inner peripheral surface of the top plane portion 330A, and a portion from the inner peripheral surface of the outer leg portion 330C to the inner peripheral surface of the top plane portion 330A are formed in a curved surface, thereby forming thicker portions 330D and 330E, respectively.

According to the embodiment, when the ink cartridge is mounted on the flow channel member 30, the point at which a pressing load is applied on the top plane portion 330A via the leg portion 21A of the ink cartridge 20 is located at the position P offset from the center of the width of the top plane portion 330A toward the outer leg portion 330C, as shown in FIG. 2C. Therefore, it is possible to form the compact sealing member 330 having the narrower width of the top plane portion 330A.

The curve radius of the curved surface constituted by the inner peripheral surface of the inner leg portion 330B and the inner peripheral surface of the top plane portion 330A is equal to, for example, a distance $\phi$1 from an innermost point of an end face 330F of the inner leg portion 330B to the intersection of a horizontal line through the innermost point and the normal through the position P, and the curve radius of the curved surface constituted by the inner peripheral surface of the outer leg portion 330C and the inner peripheral surface of the top plane portion 330A is equal to, for example, a distance $\phi$2 from an innermost point of an end face 330G of the outer leg portion 330C to the intersection of a horizontal line through the innermost point and the normal through the position P, whereby, the thicker portions 330D and 330E may be formed to satisfactorily distribute the stress to prevent stress concentration.

Furthermore, the end face 330F of the inner leg portion 330B and the end face 330G of the outer leg portion 330C are curved. As a result, even if the inner leg portion 330B and the outer leg portion 330C of the sealing member 330 are arranged obliquely with respect to the flow channel member main body 310, the gap between the end faces of the inner leg portion 330B and the outer leg portion 330C and the flow channel member main body 310 may be removed to maintain satisfactory seal performance.

Figure 3A:
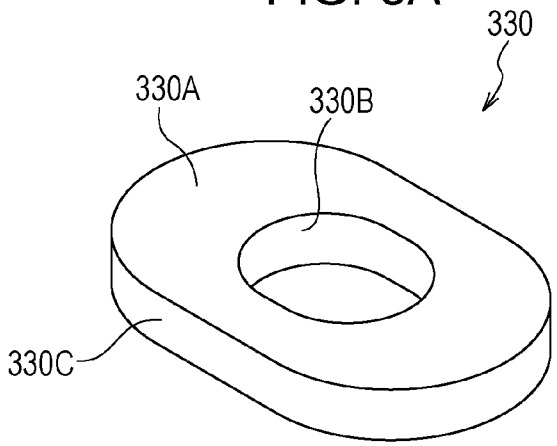
FIGS. 3A and 3B are perspective views of a sealing member of the embodiment.
Figure 3B:
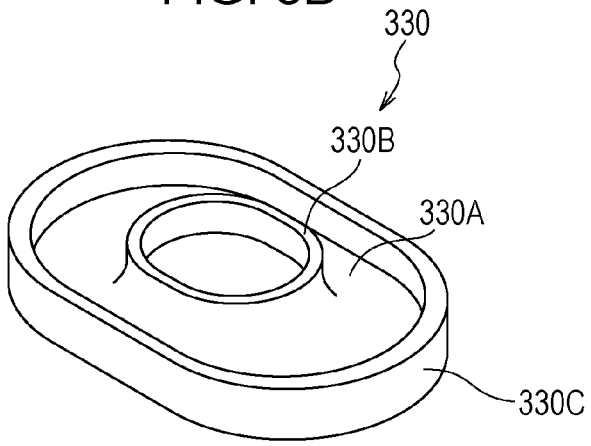

The entire shape of the sealing member 330 will be described in detail with reference to FIGS. 3A and 3B. FIGS. 3A and 3B are perspective views illustrating the entire sealing member. As shown in FIGS. 3A and 3B, the sealing member 330 is made of a flexible material such as rubber or elastomer, and integrally formed from the flat top plane portion 330A, the cylindrical inner leg portion 330B, and the cylindrical outer leg portion 330C having an inner diameter larger than the inner leg portion 330B.

The inner leg portion 330B has an inner diameter so that it may come into close contact with the circumference of the installation section 316. In addition, the outer leg portion 330C has an outer diameter somewhat smaller than the sealing groove 319 arranged around the periphery of the installation section 316. The sealing member 330 is arranged so as to fit into the periphery of the installation section 316. Since the top plane portion 330A is supported by the upper end of the inner leg portion 330B (the end closer to the ink cartridge 20) and the upper end of the outer leg portion 330C, load from the ink cartridge 20 causes the top plane portion 330A to easily sag between the inner leg portion 330B and the outer leg portion 330C so as to be convex downward toward the flow channel member main body 310.

The ink cartridge 20 has the shape of a hollow box for storing an ink (liquid) therein as shown in FIGS. 1 and 2A. In addition, at the bottom of the ink cartridge 20, a cylindrical rib 21 is arranged, and in the inner side of rib 21, a supply port 22 is arranged for supplying the ink in the ink cartridge 20 to the flow channel member 30. A supply section 23 is arranged in the inner side of the supply port 22. The supply section 23 is provided to press against the filter 317 of the flow channel member 30 to supply the ink in the ink cartridge 20 to the liquid flow channel 311 of the flow channel member 30. The supply section 23 may include, for example, a porous material or a nonwoven fabric such as cotton-like pulp, water-absorbent polymer, and urethane foam. The leg portion 21A, i.e., an annular protrusion, abutting the top plane portion 330A of the sealing member 330 is arranged so as to protrude from the lower end face of the rib 21.

The head body 40 has, on the side opposite from the flow channel member 30, a liquid ejecting surface including a nozzle discharging liquid ink droplets. In addition, the interior (not shown) of the head body 40 contains a liquid flow channel with which both of the nozzle and the channel in the flow channel member 30 communicate, and a pressure generator causing a change in the pressure of the ink in the liquid flow channel, and so forth. The pressure generator may be, for example, a device for discharging ink droplets from a nozzle by deformation of a piezoelectric actuator having a piezoelectric material exhibiting an electromechanical transducer function to cause a change in the volume of the liquid flow channel, thereby causing a change in the pressure of the ink in the liquid flow channel, a device for discharging ink droplets from a nozzle by forming bubbles generated by heat from a heater element arranged in the liquid flow channel, a device, so-called electrostatic actuator, for discharging ink droplets from a nozzle by generating electrostatic force between a diaphragm and an electrode to transform the diaphragm, and so forth.

According to the ink jet recording head 10, the ink from the ink cartridge 20 is supplied via the flow channel member 30 to the head body 40, in which a pressure generator causes a change in the pressure of the ink in the liquid flow channel, thereby discharging the ink droplets from a nozzle.

A method for mounting the ink cartridge 20, which has been removed from the flow channel member 30, on the flow channel member 30 will now be described with reference to FIGS. 4A and 4B and FIGS. 5A and 5B. FIGS. 4A to 5B are sectional views illustrating a procedure for mounting the ink cartridge according to the embodiment to the flow channel member.

Figure 4A:
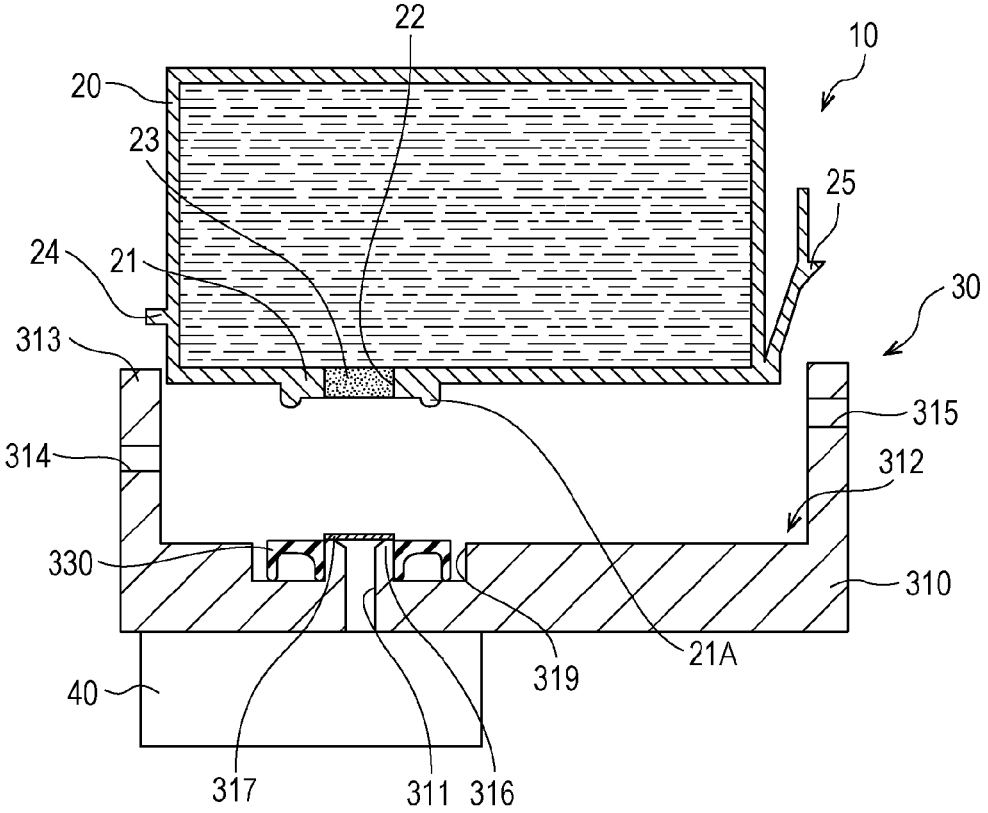
FIGS. 4A and 4B are sectional views illustrating a procedure for mounting an ink cartridge on a flow channel member.
Figure 4B:
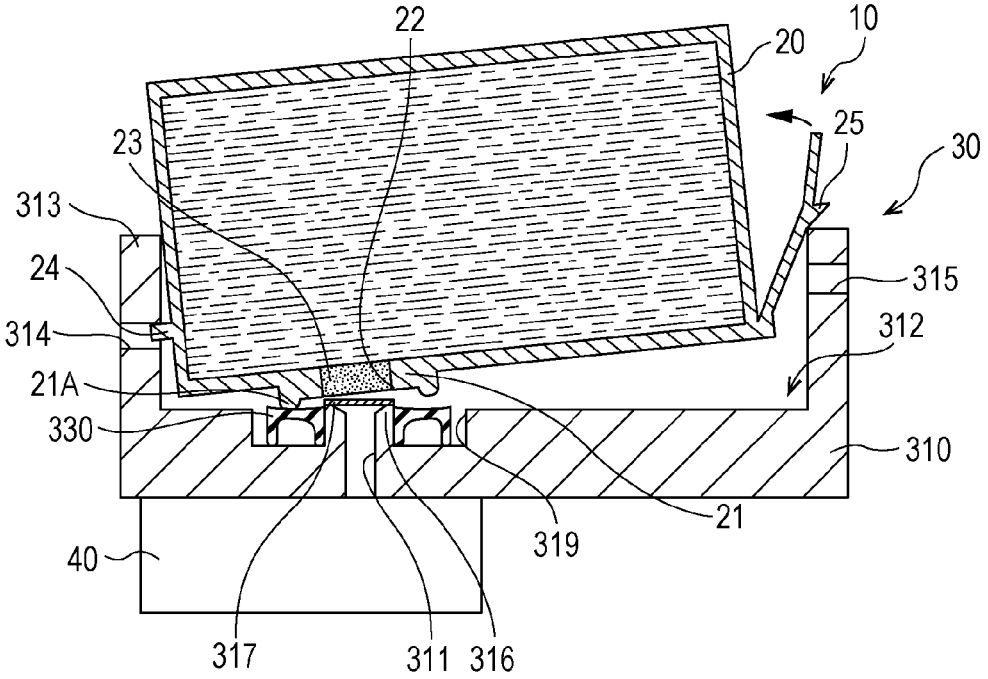

As shown in FIG. 4A, the ink cartridge 20 has been removed from the flow channel member 30. The ink cartridge 20 is inserted obliquely, the first engagement claw 24 first, into the interior of the wall portion 313 of the flow channel member main body 310, as shown in FIG. 4B, and then the first engagement claw 24 is inserted into the first engagement hole 314. Therefore, the rib 21 of the ink cartridge 20 abuts the portion of the sealing member 330 close to the first engagement hole 314.

Figure 5A:
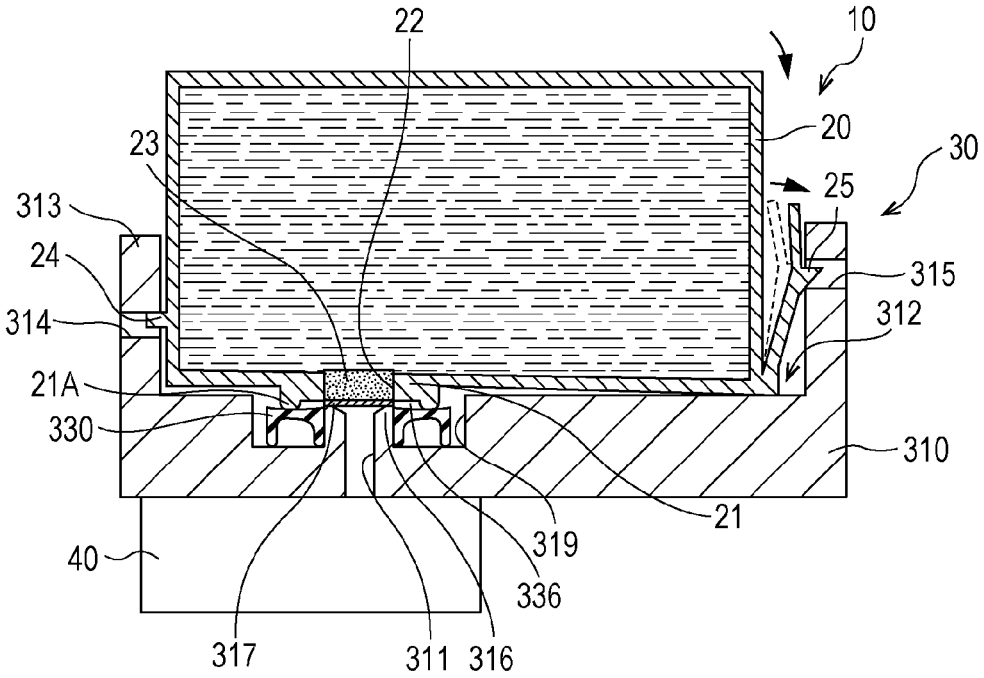
FIGS. 5A and 5B are sectional views illustrating the procedure for mounting the ink cartridge on the flow channel member.

As shown in FIG. 5A, when the first engagement claw of the ink cartridge 20 is inserted into the first engagement hole 314, the ink cartridge 20 rotates around the first engagement claw 24 serving as a fulcrum to cause the ink cartridge 20 to be inserted into the inside of the wall portion 313. The second engagement claw 25 is then pressed by the wall portion 313 of the flow channel member main body 310 to become elastically deformed so that it does not disturb insertion of the ink cartridge 20 into the inside of the wall portion 313.

In addition, according to the embodiment, the ink cartridge 20 has the second engagement claw 25 inserted into the second engagement hole 315, and then the ink cartridge is pressed further into the inside of the wall portion 313, i.e., toward the side facing the head body 40. Therefore, the rib 21 of the ink cartridge 20 causes the sealing member 330 to sag down so as to be convex downward toward the flow channel member main body 310. As a result, the inner side of the rib 21 is sealed.

Figure 5B:
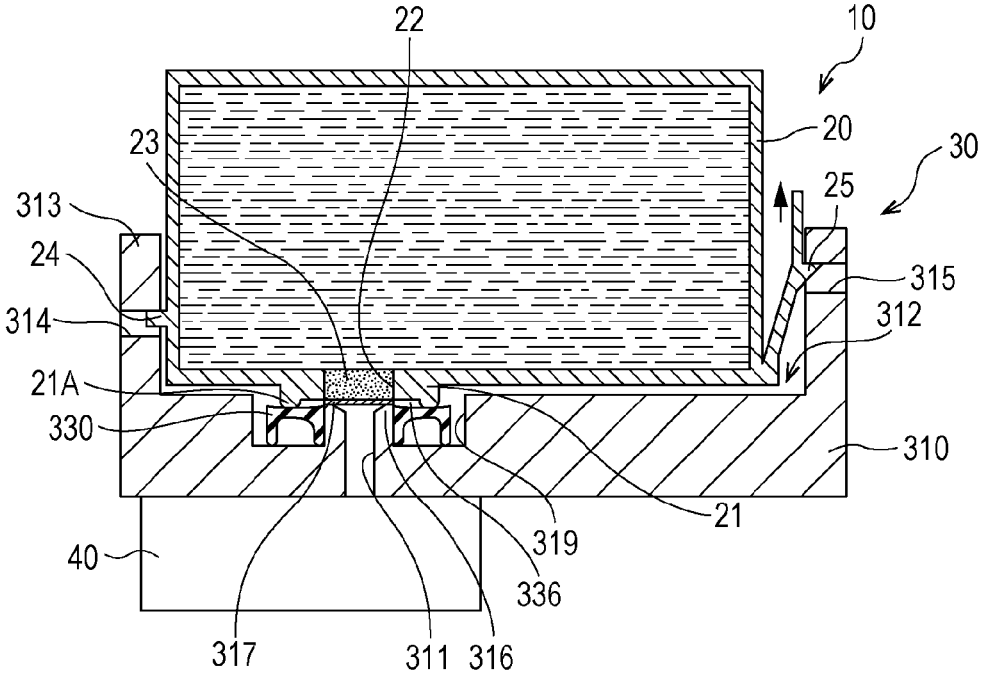

In such a case, release of pressing force from the ink cartridge 20 moves the ink cartridge 20 away from the installation section 316 by the reaction force (elastic force) from the sealing member 330, as shown in FIG. 5B. Then, the second engagement claw 25 which has been elastically transformed by the pressing force by the wall portion 313 of the flow channel member main body 310 is inserted into the second engagement hole 315 by the restoring elastic force. Then, the reaction force of the sealing member 330 and the elastic force of the second engagement claw 25 cause the second engagement claw 25 to abut the wall portion 313 including the second engagement hole 315 away from the installation section 316 so that the ink cartridge 20 is secured to the cartridge mounting section 312 of the flow channel member 30.

For the sealing member 330 according to the embodiment, the thicker portion 330D of the inner leg portion 330B distributes the stress from the ink cartridge 20 via the top plane portion 330A (see FIGS. 2A to 2C). As a result, creep resistance of the sealing member 330 may be improved, and the adhesion of the outer peripheral surface of the inner leg portion 330B with respect to the outer peripheral surface of the installation section 316 may be stably maintained over the long term. In addition, the amount of liquid leakage from the enclosed space 336 may also be minimized.

The inner peripheral surface of the thicker portion 330D is curved to efficiently perform particularly satisfactory distribution of the stress acting on the sealing member 330.

Having described the embodiment of the invention hereinbefore, the basic configuration of the invention is not limited to the above-described configuration. For example, in the embodiments, a curved surface, i.e., the thicker portion 330D makes up a part of the inner peripheral surface of the inner leg portion 330B, and further a curved surface, i.e., the thicker portion 330E makes up a part of the inner peripheral surface of the outer leg portion 330C, however, only the thicker portion 330D may be formed in the inner leg portion 330B. This is because, due to contact of the outer peripheral surface of the inner leg portion 330B and the outer peripheral surface of the installation section 316, sealing performance between them significantly affects particularly the lifetime of the sealing member 330.

In addition, the thicker portion is not necessarily formed into a curved surface. A curved surface performs the best stress distribution, but at least the inner leg portion 330B needs to be formed so that the thickness thereof increases gradually from the end face 330F of the inner leg portion 330B toward the inner peripheral surface of the top plane portion 330A and the distance between the inner peripheral surface of the inner leg portion 330B and the inner peripheral surface of the outer leg portion 330C decreases gradually. Therefore, the inner leg portion 330B may be formed into a linear shape, such as a tapered shape. Furthermore, the end faces 330F and 330G are also not necessarily formed into curved surfaces. However, even if the sealing member 330 is arranged obliquely with respect to the flow channel member main body 310, the sealing performance may be improved.

Figure 6:
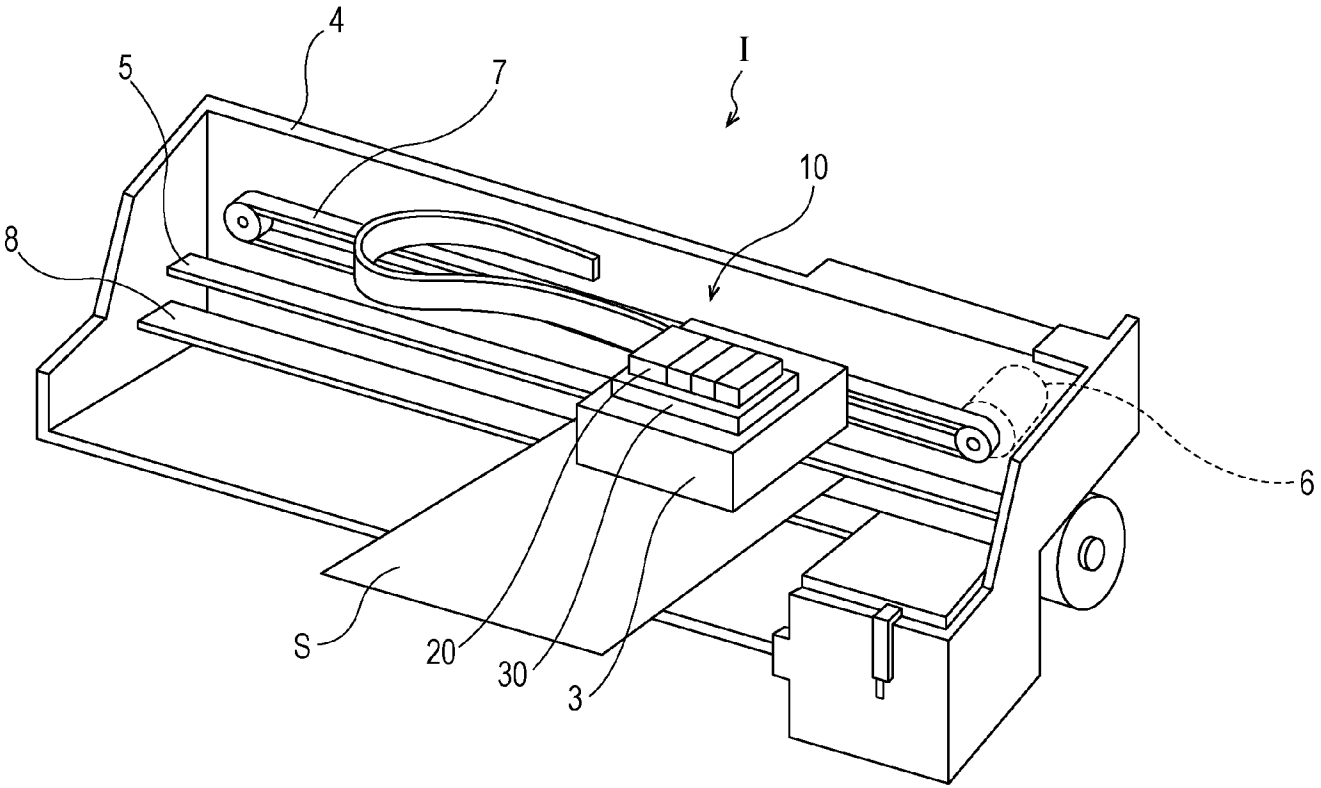
FIG. 6 is a schematic view of a recording apparatus according to an embodiment of the invention.

In addition, the ink jet recording head 10 according to the embodiment forms a portion of the ink jet recording head unit having the ink channel communicating the ink cartridge or the like to be incorporated in the ink jet recording apparatus. FIG. 6 is a schematic view illustrating an example of the ink jet recording apparatus.

According to an ink jet recording apparatus I shown in FIG. 6, ink cartridges 20 constituting an ink supply device are removably arranged in an ink jet recording head 10, and a carriage 3 incorporating the ink jet recording head 10 is movably arranged along the axis of the carriage shaft 5 on an apparatus body 4. The ink jet recording head 10, for example, may discharge a black ink composition and a color ink composition.

Then, driving power from a drive motor 6 is transmitted via a plurality of gears (not shown) and a timing belt 7 to the carriage 3 so that the carriage 3 incorporating the ink jet recording head 10 moves along the carriage shaft 5. The apparatus body 4 has a platen 8 along the carriage shaft 5, and recording sheets S, i.e., recording media such as paper sheets or the like fed by a paper feeding roller (not shown) or the like are transported on the platen 8.

According to the embodiments, the ink jet recording head 10 having the flow channel member 30 has been described; however, the invention is also applicable to an ink jet recording apparatus having the flow channel member 30 in a position other than the ink jet recording head 10. In particular, if the ink jet recording apparatus includes an ink tank, i.e., a liquid reservoir for storing an ink therein which is not incorporated in the carriage 3 but secured to the apparatus body 4, and a tubular supply pipe interconnecting the ink tank and the head body 40, for example, the flow channel member 30 described above may be arranged in the place where the ink tank is provided.

In addition, the ink jet recording apparatus I is, but is not limited to, an apparatus having the ink jet recording head 10 incorporated in the carriage 3 that moves in a main scanning direction, and for example, the invention is also applicable to a so-called line recording apparatus performing printing simply by moving a recording sheet S such as paper in a vertical scanning direction with the ink jet recording head 10 secured in position.

Furthermore, the invention is generally targeted for a liquid ejecting head, and is also applicable to a method for manufacturing, for example, a recording head among various ink jet recording heads or the like used for an image recording apparatus of a printer or the like, a color material ejecting head used for manufacturing a color filter of a liquid crystal display or the like, an electrode material ejecting head used for forming an electrode of an organic EL display, a field emission display (FED) or the like, a living organic material ejecting head used for manufacturing a biochip, or the like.

In addition, the invention is not limited to a flow channel member incorporated in a liquid ejecting head and a liquid ejecting apparatus, and may be applicable to flow channel members incorporated in other devices.

The entire disclosure of Japanese Patent Application No. 2012-189627, filed Aug. 30, 2012 is incorporated by reference herein.

What is claimed is:

1. A flow channel member disposed between a liquid reservoir for storing a liquid therein and a head body for ejecting the liquid, comprising:

a flow channel member main body having a liquid flow channel, through which the liquid flows from the liquid reservoir via one port into the head body via another port and having an installation section for mounting the liquid reservoir formed by a periphery of the one port; and a sealing member made of an elastic material, arranged around the entire periphery of the installation section of the flow channel member main body, wherein the sealing member is integrally formed of: a top plane portion, where an end face of an annular leg portion of the liquid reservoir abuts the top plane portion so as to define an enclosed space between an inner peripheral surface of the annular leg portion and an outer peripheral surface of the installation section; and an inner leg portion adjacent to the installation section and an outer leg portion away from the installation section, extending from an inner edge and an outer edge of the top plane portion, respectively, along a longitudinal axis of the installation section in a direction away from the enclosed space, and each having a face abutting the flow channel member main body, wherein the sealing member is formed so that the annular leg portion of the liquid reservoir is arranged on the flow channel member to abut the top plane portion at a position offset from a center of a width of the top plane portion toward the outer leg portion, when the liquid reservoir is mounted on the flow channel member, and wherein a first thicker portion is provided at a corner between the to plane portion and the inner leg portion, a second thicker portion is provided at a corner between the top plane portion and the outer leg portion, a first thickness of the first thicker portion and a second thickness of the second thicker portion are thicker than other thicknesses of the to plane portion, and the inner and outer leg portions so that the distance between an inner peripheral surface of the inner leg portion and an inner peripheral surface of the outer leg portion decreases gradually from the flow channel member toward an inner peripheral surface of the top plane portion, and the first thickness is thicker than the second thickness.

2. The flow channel member according to claim 1, wherein the first and second thicker portions have the inner peripheral surface formed so as to be a curved surface.

3. A liquid ejecting apparatus comprising the flow channel member according to claim 2.

4. A liquid reservoir mounted on the installation section of the flow channel member according to claim 2.

5. A liquid ejecting head comprising the flow channel member according to claim 2.

6. A liquid ejecting apparatus comprising the liquid ejecting head according to claim 5.

7. The flow channel member according to claim 1, wherein end faces of the outer leg portion and the inner leg portion of the sealing member are curved.

8. A liquid ejecting apparatus comprising the flow channel member according to claim 7.

9. A liquid reservoir mounted on the installation section of the flow channel member according to claim 7.

10. A liquid ejecting head comprising the flow channel member according to claim 7.

11. A liquid ejecting apparatus comprising the liquid ejecting head according to claim 10.

12. A liquid ejecting head comprising the flow channel member according to claim 1.

13. A liquid ejecting apparatus comprising the liquid ejecting head according to claim 12.

14. A liquid ejecting apparatus comprising the flow channel member according to claim 1.

15. A liquid reservoir mounted on the installation section of the flow channel member according to claim 1.

* * * * *